US008230827B2

(12) United States Patent
Jaquet

(10) Patent No.: US 8,230,827 B2
(45) Date of Patent: Jul. 31, 2012

(54) INTERNAL COMBUSTION ENGINE WITH VARIABLE COMPRESSION RATIO

(76) Inventor: Jacob Arnold Hendrik Frederik Jaquet, Valburg (NL)

( * ) Notice: Subject to any disclaimer, the term of this patent is extended or adjusted under 35 U.S.C. 154(b) by 872 days.

(21) Appl. No.: 12/279,373

(22) PCT Filed: Feb. 6, 2007

(86) PCT No.: PCT/NL2007/000034

§ 371 (c)(1),
(2), (4) Date: Dec. 8, 2008

(87) PCT Pub. No.: WO2007/094657

PCT Pub. Date: Aug. 23, 2007

(65) Prior Publication Data

US 2009/0188471 A1 Jul. 30, 2009

(30) Foreign Application Priority Data

Feb. 16, 2006 (NL) ..... 1031165

(51) Int. Cl.
*F02B 75/18* (2006.01)

(52) U.S. Cl. ..... 123/56.1; 123/52.1; 123/48 R; 123/48 D; 123/78 R

(58) Field of Classification Search ..... 123/48 A, 123/48 AA, 48 B, 48 C, 51 R, 51 BC, 56.1, 123/52.1, 53.3, 53.6, 55.5, 56.8, 61 R, 48 R, 123/48 D, 78 R, 78 BA, 78 E, 78 F
See application file for complete search history.

(56) References Cited

U.S. PATENT DOCUMENTS

| | | | | |
|---|---|---|---|---|
| 2,368,933 | A * | 2/1945 | Lindeman, Jr. | 74/60 |
| 2,513,083 | A | 6/1950 | Eckert | |
| 3,485,221 | A * | 12/1969 | Feeback | 123/51 AA |
| 4,043,301 | A * | 8/1977 | Rheingold | 123/57.1 |
| 4,129,102 | A * | 12/1978 | van der Lely | 123/51 B |
| 4,237,831 | A * | 12/1980 | Noguchi et al. | 123/51 BA |
| 4,622,927 | A * | 11/1986 | Wenker | 123/51 B |
| 4,886,021 | A * | 12/1989 | Seeber et al. | 123/73 PP |
| 5,218,933 | A * | 6/1993 | Ehrlich | 123/55.3 |
| 6,155,214 | A * | 12/2000 | Manthey | 123/43 AA |
| 6,250,264 | B1 * | 6/2001 | Henriksen | 123/56.2 |
| 7,258,086 | B2 * | 8/2007 | Fitzgerald | 123/46 R |
| 2006/0185631 | A1 * | 8/2006 | Fitzgerald | 123/55.5 |

FOREIGN PATENT DOCUMENTS

| | | |
|---|---|---|
| DE | 37 11 205 | 10/1988 |
| FR | 1 364 498 | 6/1964 |
| GB | 180 767 | 6/1922 |

* cited by examiner

*Primary Examiner* — Noah Kamen
*Assistant Examiner* — Long T Tran
(74) *Attorney, Agent, or Firm* — Eric Karich

(57) ABSTRACT

An internal combustion engine has at least one cylinder, and a means for varying the compression ratio in the cylinder. The at least one cylinder has two oppositely directed reciprocatingly movable pistons in it, which are each connected via a piston rod with a corresponding arm, whereby each arm shows an opening in which a main shaft that connects the two arms is rotatably supported in bearings. The main shaft includes an angle with a center line of each opening. The means for varying the compression ratio in the cylinder includes a division in the main shaft, as well as drive means in order to move the parts formed by it of the main shaft apart from each other.

22 Claims, 11 Drawing Sheets

INTERNAL COMBUSTION ENGINE WITH VARIABLE COMPRESSION RATIO

BACKGROUND OF THE INVENTION

Field of the Invention

The invention relates to an internal combustion engine of which the compression ratio can be varied. More in particular, the invention relates to an internal combustion engine, comprising at least one cylinder with two oppositely reciprocating pistons in it, which are each connected via a piston rod with a corresponding arm, whereby each arm shows an opening in which a main shaft connecting both arms is rotatably supported in bearings, which main shaft includes an angle with a centre line of each opening, and means for varying the compression ratio in the cylinder. Such an engine is known, for example from the U.S. Pat. No. 4,622,927.

The compression ratio of an internal combustion engine is determined by dividing the cylinder capacity with the volume of the combustion space, when the piston is in its top dead point. With other words: the compression ratio indicates the amount of pressure with which the mixture of air and fuel is compressed before it is ignited. The compression ratio determines to a great extent the output of an engine. In general the output increases in relation to the increase of the pressure in the combustion space, but that does not proceed unlimited.

At a too high compression so-called knocking occurs, particularly at high revolutions and at full load. This is the early spontaneously exploding of the mixture whereby damage can be inflicted to the pistons. The moment whereby knocking occurs is the utmost limit on basis of which the compression ratio is determined. Thereafter it stays equal irrespective of the number of revolutions or the load. But particularly with a lower number of revolutions and lower force a higher compression ratio would be desirable for a better output. However, mostly the level of the compression ratio of an internal combustion engine for use in a vehicle will be the result of a compromise, because of which the engine offers the best attainable combination of performance in the city, on the country-road and when driving at high speed on the motorway.

Some research has been carried out on possibilities to vary the compression ratio of internal combustion engines, to obtain in this manner good performance and an optimal output under all circumstances.

However, for conventional petrol engines this is extremely complicated constructively. Commonly, such engines are provided with a number of cylinders that are placed in line, in V-shape or presently even in W-shape next to each other or placed in a boxer arrangement opposite each other. Each of these cylinders, in which a piston moves up and down, is closed off at the topside with a cylinder head fixed onto it, in which the intake and exhaust valves are taken up, as well as the spark plug(s). The piston closes off the other side of the cylinder and is connected via a connecting rod with a crank of a common crankshaft for all pistons of the engine. This crankshaft converts the up and down movement of the pistons into a rotational movement used for driving of e.g. a vehicle. As a consequence of the construction described herein, conventional internal combustion engines are less suitable for varying the compression ratio.

A recent example of an effort to still vary the compression ratio in such a conventional internal combustion engine is the so-called SVC-engine, recently presented by the Swedish manufacturer Saab as a prototype. This SVC-engine comprises two parts that reciprocate with respect to each other.

That are on the one hand a cylinder head with cylinder barrels fixed onto it, thus in fact a cylinder block, and on the other hand a carter with in it a crankshaft and pistons. By wobbling the cylinder block with regard to the carter, the volume of the combustion space changes when the piston is in the top dead point, and thereby the compression ratio changes too. It will be clear that this is a complicated construction, of which the movements are difficult to control and moreover probably by itself already requires a considerable capacity. The only reason to consider such a design seems to be in view of the desire to join as much as possible the existing engine configurations.

In order to vary the compression ratio more easily, a radically other basic design of the internal combustion engine is necessary. Such a design is proposed in the above-mentioned U.S. Pat. No. 4,622,927. In this patent a four-cylinder petrol engine is described of which the cylinders are mutually arranged parallel around a central main shaft, which is functionally comparable to the crankshaft of a conventional engine. In each cylinder are two pistons movable in opposite direction. In the end position in which the pistons approach each other the closest, the top dead point, they determine together the combustion space. Thus in this construction no separate head is necessary to close off the cylinder. The spark plug protrudes at the cylinder wall into the combustion space, and the intake and exhaust gates are also formed in the cylinder wall. This will be closed with slidable cylinder barrels, in which the pistons move.

Each piston is connected, by means of a piston rod, which is supported in bearings in a guiding, with an arm The arms of the four pistons at each side of the engine are fastened onto a disc, which shows a central opening, in which the main shaft is rotatably supported in bearings. Thereby the disc is placed under an angle with regard to the main shaft, so that it can execute a wobble movement during a rotation of the main shaft. In this manner the reciprocating movements of the pistons and piston rods thus result as a consequence of the consecutive combustion of petrol/air mixture in the various cylinders to a wobble movement of the disc and with it to a rotation of the main shaft. This rotation can be used for driving of, for example, a vehicle.

As said an internal combustion engine of this type can be made suitable in a relatively simple manner for varying the compression ratio. Therefore one of the wobble discs is displaceable along the main shaft. When displacing the wobble disc with regard to the other wobble disc, the space between the pistons at their top dead point is reduced or enlarged, and with it the compression ratio is accordingly increased, respectively decreased.

Although the above discussed internal combustion engine according to U.S. Pat. No. 4,622,927, also indicated as the wobble disc engine, should function satisfactory in theory, it however does show some practical disadvantages. These disadvantages concern in the first place the mechanisms for varying the compression ratio, which are not robust enough. Other problem areas are the positioning of the spark plugs and the complicated construction and operation of the intake and exhaust valves. In addition, the connection between the pistons and the wobble disc results into unwanted extra loads on the heaviest loaded engine components. Finally the lubrication and the thermal management of the engine are points requiring attention.

According to a first aspect of the invention, an internal combustion engine of the type as described in the beginning shows the characteristic that the compression ratio variation means comprise a division in the main shaft, as well as drive means in order to displace the parts formed by it of the main shaft with regard to each other. The varying of the compression ratio by the lengthening or shortening of the main shaft results, compared to the displacement of a wobble disc along the main shaft, into a more compact construction. This is of importance, because the engine with the chosen arrangement of the pistons opposite each other is relatively long compared to conventional internal combustion engines with the cylinders in line or V-shape.

A robust and simple adjustable mechanism is obtained, when the drive means comprises a screw spindle included at the position of the division in the main shaft, which is supported in bearings in one of the parts of the shaft and cooperates with a nut included in the other shaft part. Moreover, the nut can also be shaped integrally with the shaft part, in the sense that the shaft part itself is also provided with internal screw thread.

Preferably the drive means comprise a screw spindle included in the main shaft that drives the electro or hydromotor, which results into a compact construction.

In order to be able to adapt the compression ratio in a simple and reliable manner, irrespective if the engine runs, the drive means preferably comprise an adjustment devise, connected via a differential with the screw spindle, and placed outside the main shaft.

According to a second aspect of the invention, an internal combustion engine of the type described in the beginning is provided with at least one spark plug, which protrudes at the bottom of one of the pistons. With such an arrangement of the spark plug is guaranteed that it is positioned centrally in the combustion space at each compression ratio, irrespective of the mutual distance of the pistons.

This positioning of the spark plug can be achieved in a simple manner if the piston rod is hollow, and the spark plug is fastened in the piston rod. In order to reach the spark plug, for example in order to replace it, preferably the end of the piston rod showing away from the piston is open.

Placing of the spark plug in the piston requires a special voltage supply. For this purpose the internal combustion engine is equipped in a preferred embodiment with the spark plug, which is connected with an electrical conductor that extends within the piston rod, of which a voltage supply part is slidable along an elongated voltage supply device.

According to yet another aspect of the invention the internal combustion engine is in addition provided advantageously with means for metering air or a fuel/air mixture to the cylinder, which supply means comprise at least one metering device connected with the main shaft and in this manner rotatable along at least one supply opening, which metering device can be brought into governing with the supply opening by the rotation. Such a metering device rotating together with the main shaft can be realised much easier, both constructively as well as from the viewpoint of control, than the slidable cylinder barrels according to the above discussed state of the art.

In order to bring the metering opening sufficiently long in governing with the supply opening to be able to supply a considerable quantity of air or fuel/air mixture, preferably it has a metering opening in the shape of a circle segment. Moreover, the metering device can, in order to provide various cylinders with air or a fuel/air mixture, include multiple circle segment shaped metering openings on various radii and/or with various lengths.

Another aspect of the invention provides for the internal combustion engine of the above-discussed type, that each piston rod is mounted slidably in a guide bush, and connected with the corresponding arm by means of a universal joint that is movable transversely to the direction of movement of the piston. By installing the piston rod in a guide bush, the piston can rectilinearly be moved in a reciprocating manner in the cylinder, without directly touching the cylinder wall. Compared to conventional pistons that move up and down in a wobble manner, the internal resistance of the engine, caused by it, decreases, as well as the wear. The universal joint with an extra movement possibility transversely to the direction of compression prevents that additional forces and moments occur at the position of the connection between the piston rod and the arm as a consequence of the not entirely smooth running movements at that spot.

According to yet another aspect of the invention the internal combustion engine is provided with a system for the lubrication of the pistons, comprising at least one lubrication means supply line constructed in the piston rod of the piston to be lubricated and at least one outflow opening in the casing of the piston that is connected with the supply line. In this way lubrication means can be distributed in a simple manner along the circumference of the piston.

Preferably the lubrication means supply line is placed in the neighbourhood of the piston bottom, so that it is cooled down through the lubrication means.

In order to guarantee an accurate dosing of the lubrication means a material that is permeable for the lubrication means can be included in the outflow opening.

Preferably the piston shows piston rings at both sides of the outflow opening that extend circularly around the piston casing, with which the layer of lubrication means is closed in. If in the wall of the cylinder intake and exhaust openings have been formed, it is preferred in that case that the width of the piston rings at least is equal to the diameter of die openings, so that these can pass the intake and exhaust gates evenly.

According to yet another aspect of the present invention the internal combustion engine of the above-discussed type shows the characteristic that the cylinder wall is shaped as one part. In the engine known from the afore-mentioned USA patent each cylinder consists of two halves connected together approximately in a symmetry plane of the engine. Thus, the division is located at the spot of the combustion area, where the thermic load is the highest—and moreover—changes considerably at variations of the compression ratio. Such a division on the least favourable position is prevented with the integrally shaped cylinder wall.

In connection with the thermal management of the internal combustion engine according to the invention, which contrary to conventional engines does not possess a massive engine block with cooling lines in it, the engine according to a further aspect of the invention is provided with a cooling casing that encloses the cylinder. In this way the cylinder wall can still be cooled down adequately.

In order to simplify the assembly of the engine and to optimise the cooling, preferably the cooling casing and the cylinder wall are shaped as one part.

In a preferred embodiment of the internal combustion engine the cylinder is slidable in the direction of movement of the pistons. With it both the moment of opening and closing of the intake and exhaust openings, as the amount of opening can be varied. In this manner the capacity, the usage and the emission can be controlled.

If the internal combustion engine according to the invention is finally provided with a number of cylinders that are equally divided around the main shaft, whereby the arms of the various pistons are fastened onto a common bearing ring that determines the opening of each arm, on the one hand a considerable engine capacity is achieved, while on the other hand the loads on the arms and with it on the main shaft are more equally spread. The arms and the bearing ring thereby form in fact a wobble disc, because of which this type of internal combustion engine thanks the name wobble disc engine.

BRIEF DESCRIPTION OF THE DRAWINGS

The invention will now be elucidated on basis of a number of examples that solely are intended as illustration, but are not limiting in any way. Reference is made to the annexed drawings, in which.

DETAILED DESCRIPTION OF THE INVENTION

Figure 1:
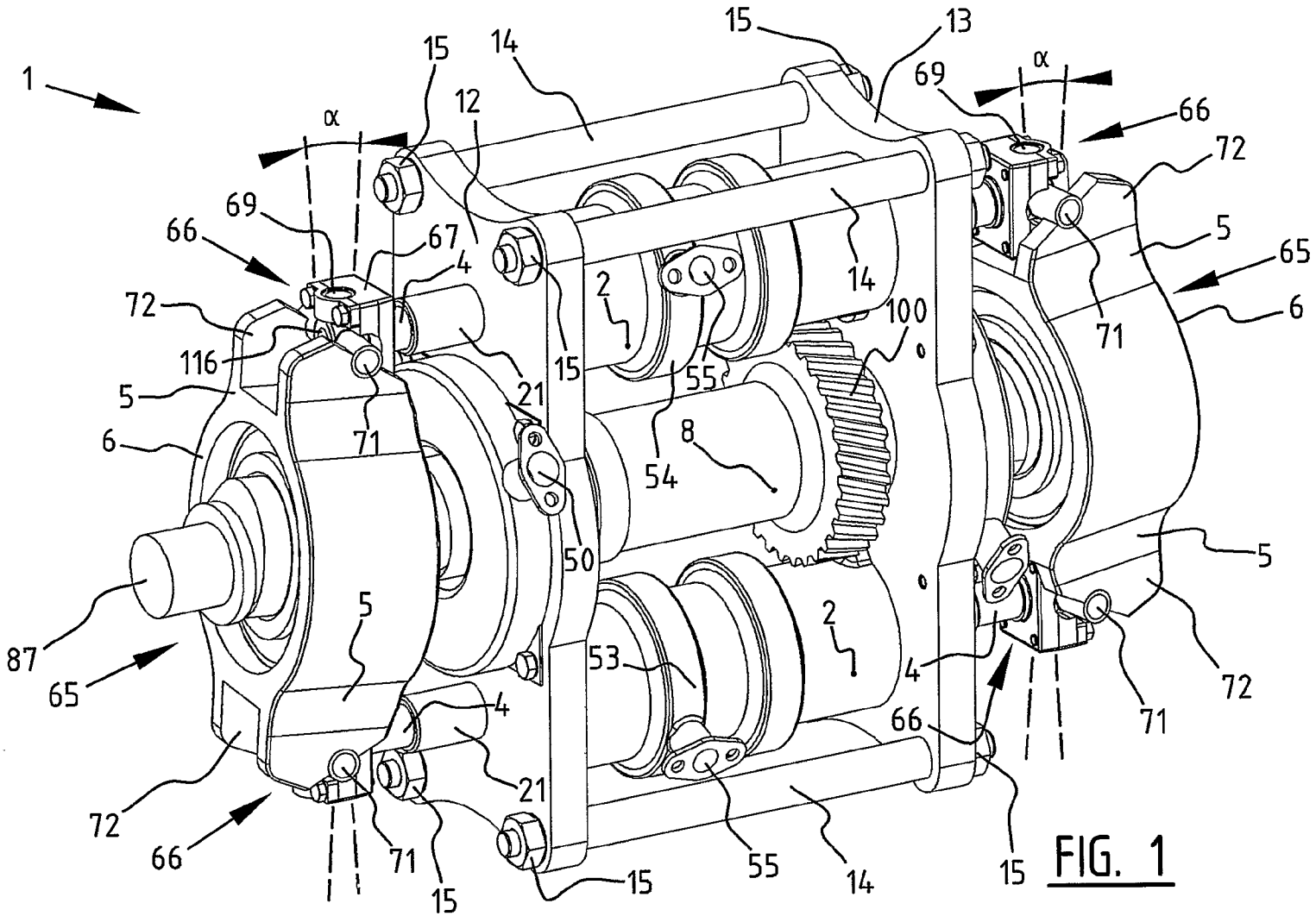
FIG. 1 is a perspective view of the internal combustion engine according to the invention.
Figure 2:
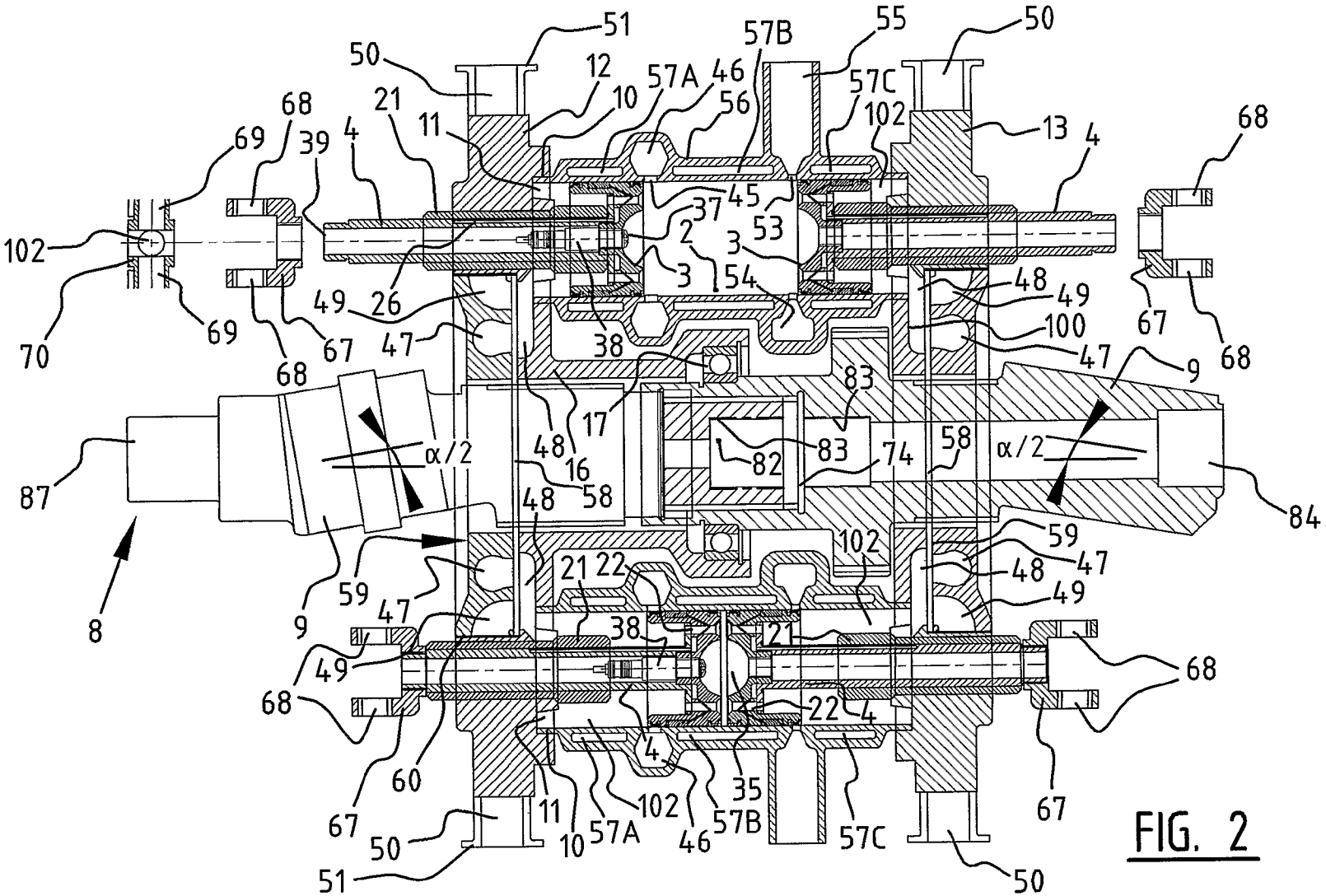
FIG. 2 is a longitudinal section of the engine, whereby the wobble discs are left out, FIGS. 3A, 3B and 3C, in combination, show an internal combustion engine that correspond with FIG. 2, whereby the components have been taken apart.
Figure 3A:
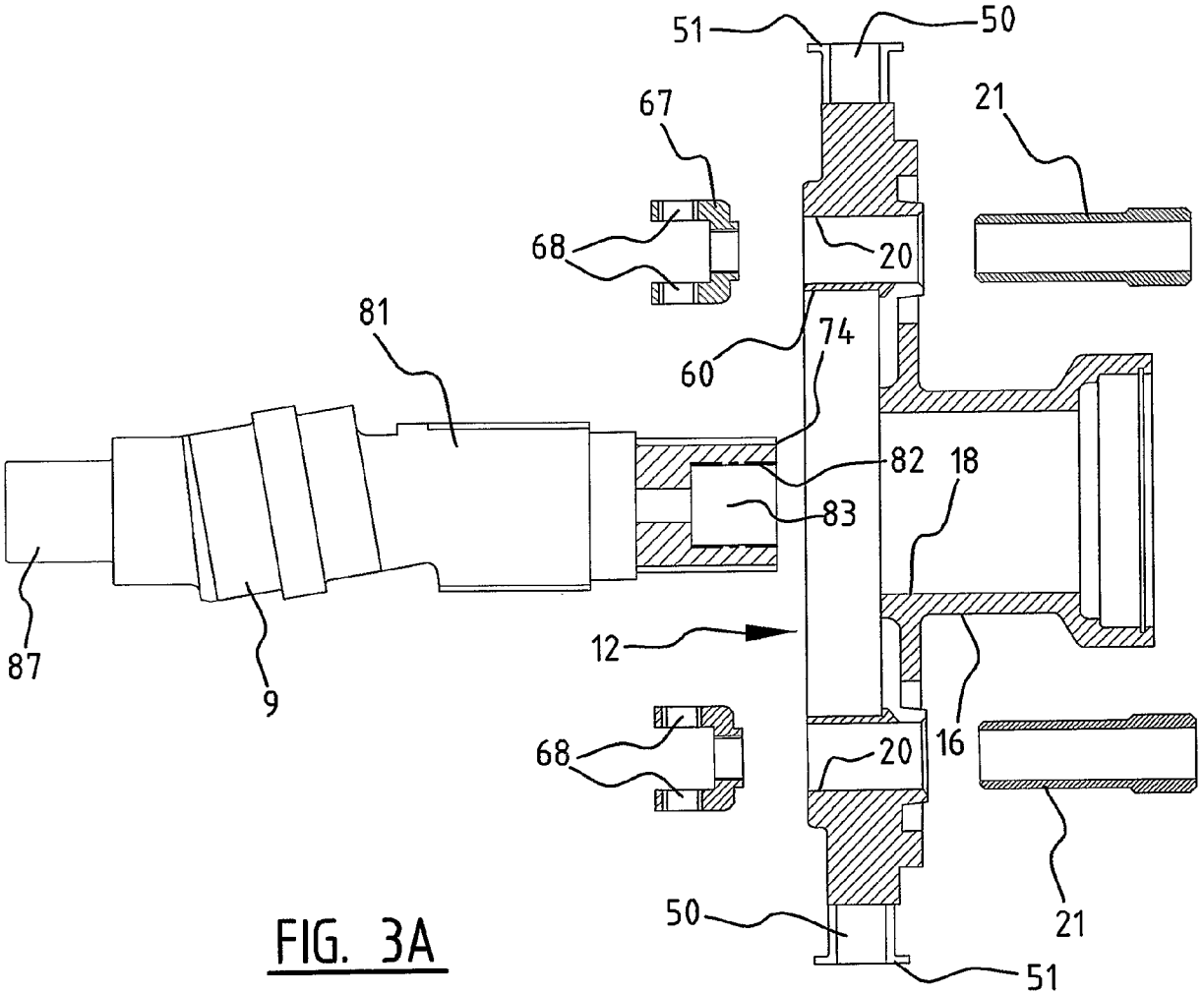
Figure 3B:
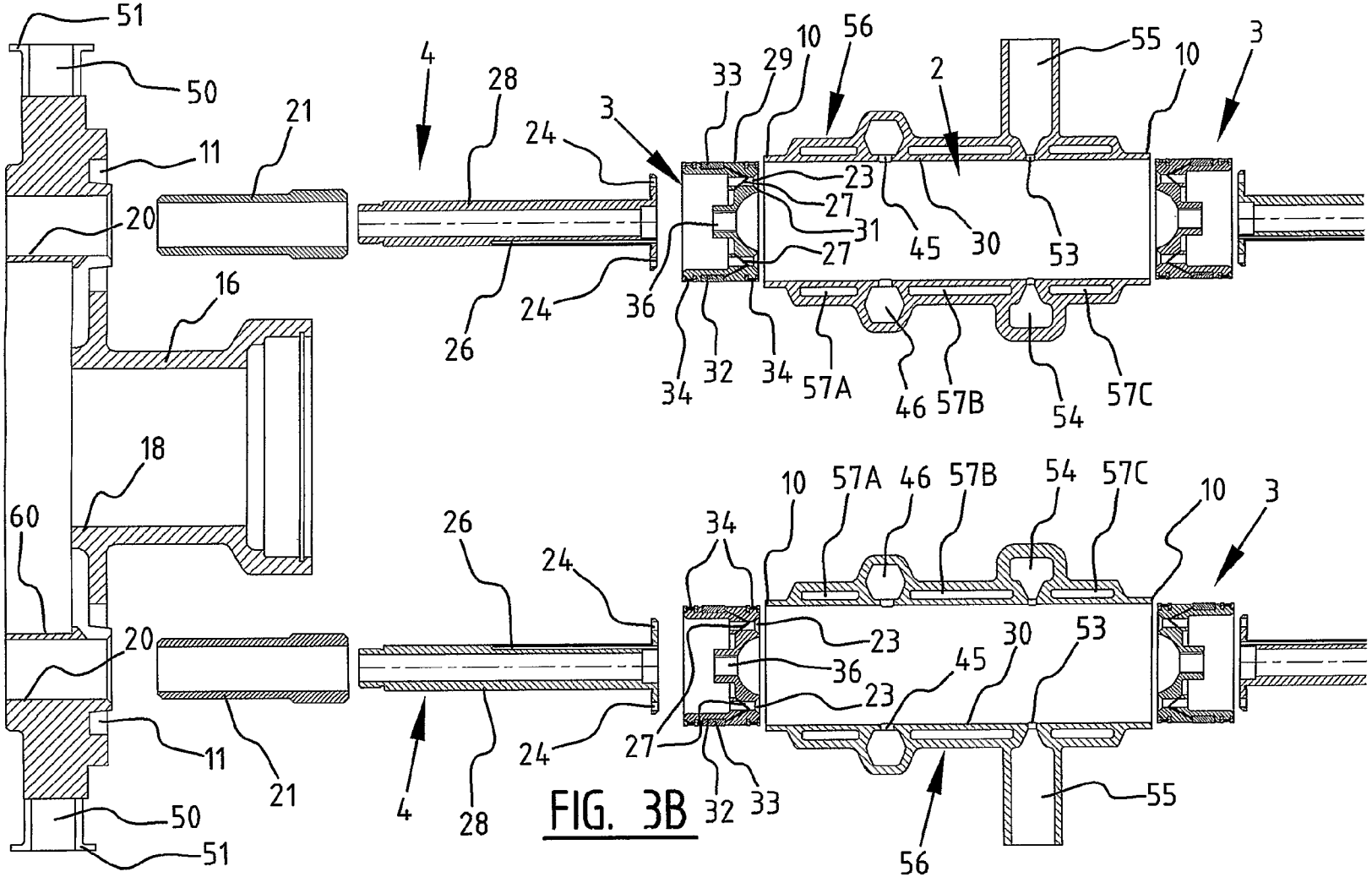
Figure 3C:
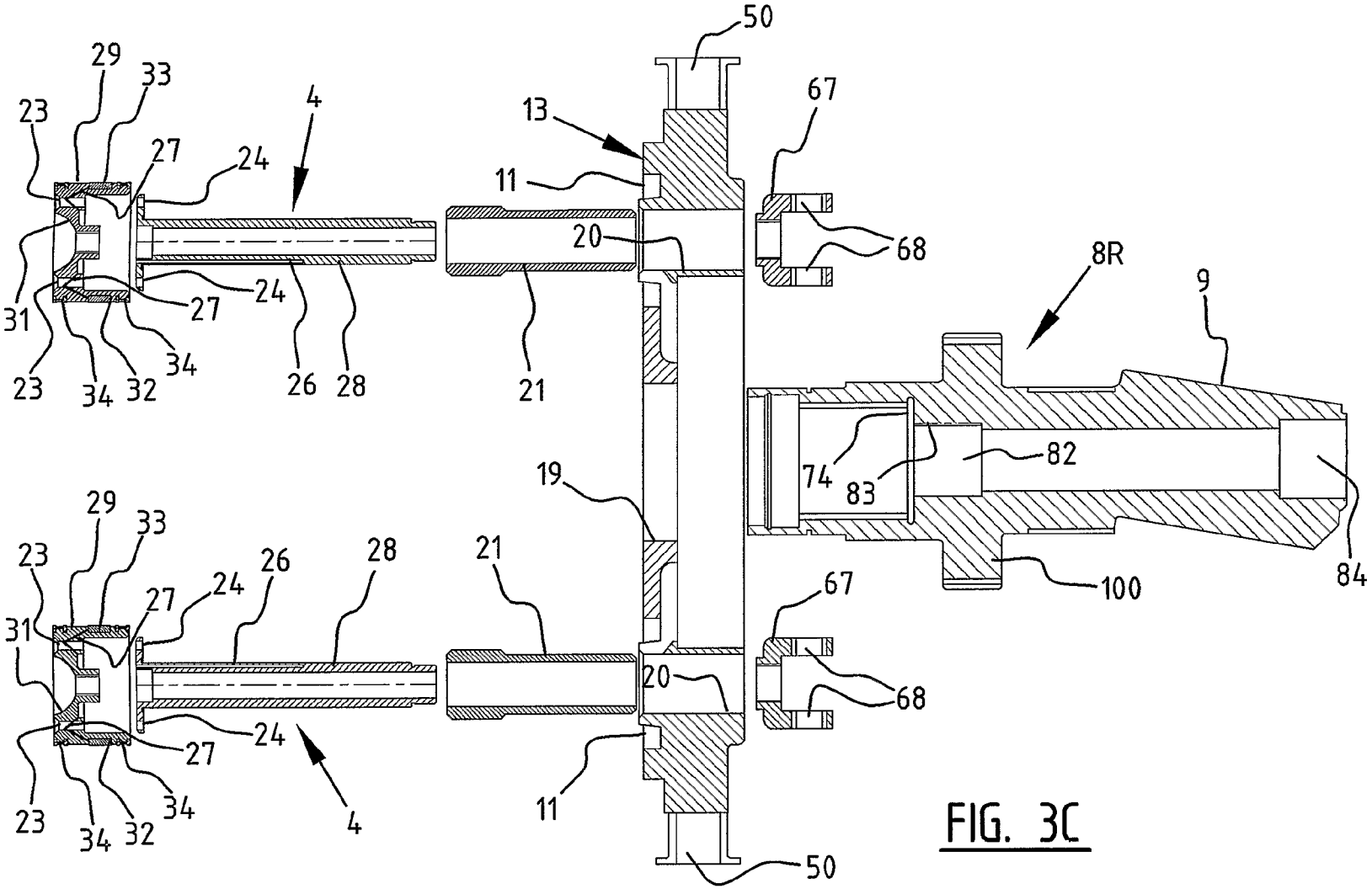

An internal combustion engine 1 (FIG. 1) comprises a number of—in the example shown are two—cylinders 2, in each or which two pistons 3 move reciprocating against each other (FIG. 2). Between the pistons 3, in each cylinder 2 a combustion space 35 is shaped, while the space 102 behind each piston 3 functions as—hereafter further to be discussed—scavenging space. The internal combustion engine 1 is elucidated in the shown example as a two-stroke engine, whereby the pistons 3 form the scavenger pumps.

Each piston 3 is connected via a piston rod 4 with a corresponding arm 5. The arms 5 of the various pistons 3 are fastened onto a common bearing ring 6 that determines an opening 7. The two bearing rings 6 on both sides of the engine 1 are connected via a main shaft 8, which shaft is rotatably supported in bearings in the openings 7 by means of two ball bearings 76. This main shaft 8 encloses an angle $\alpha$ with a centre line $C_L$ of each opening 7, and shows for this purpose bearing segments 9, where the bearing rings 6 are supported in bearings, and which are under the same angle $\alpha$ with regard to the centre line.

As a consequence of this bearing ring under an angle, the ring 6 with on it the arms 5 will execute a wobble movement when the main shaft 8 rotates, as is schematically presented by the dashed—dotted lines in FIGS. 1, 4A, 6 and 8. The assembly of the ring 6 and the arms 5 is thus also indicated as a wobble disc 65. Moreover, it will be clear that in reality the relation between the movements is the other way around; the arms 5 are brought into a wobble movement by the reciprocating pistons 3 and the piston rods 4, which at the bearing ring 6 and the bearing segments 9 is converted into a rotating movement of the main shaft 8.

The cylinders 2 are fastened with their ends 10 into grooves 11 in two end plates placed opposite each other 12, 13, which are connected with each other by bolts 14 and nuts 15. The end plate 12 thereby shows a bearing bush 16, which extend till about halfway the cylinders 2, and in which the main shaft 8 is supported in bearings by means of a ball bearing 17. The main shaft 8 extends further away from the openings 18, 19 in the end plates 12, 13.

The end plates 12, 13 further show openings 20 in which guide bushes 21 are fastened, in which in their turn the piston rods 4 are supported slidably in bearings. These piston rods 4 are fastened onto the corresponding pistons 3 by means of bolts 22, which stick at the openings 23, 24 in each piston 3, respectively each piston rod 4, and which are fastened with nuts 25.

Figure 7:
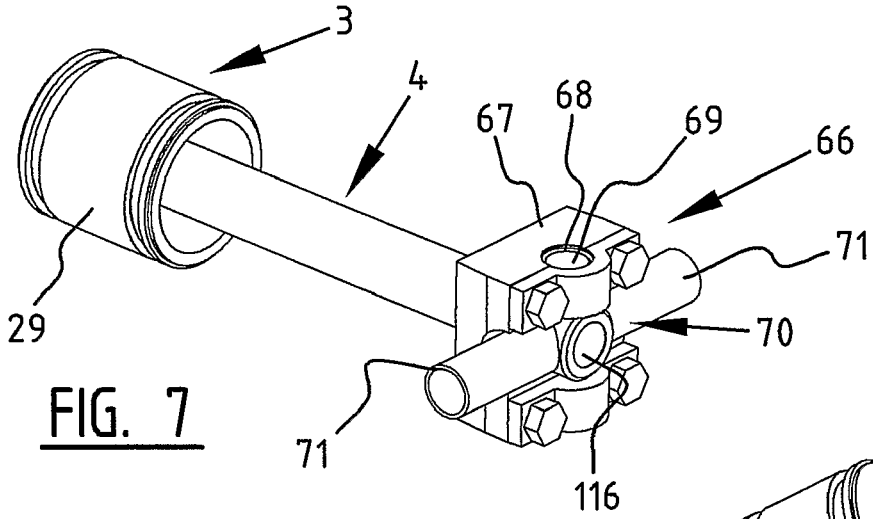
FIG. 7 is a perspective view of the piston, piston rod and universal joint as applied in the internal combustion engine according to FIG. 1-6.
Figure 9:
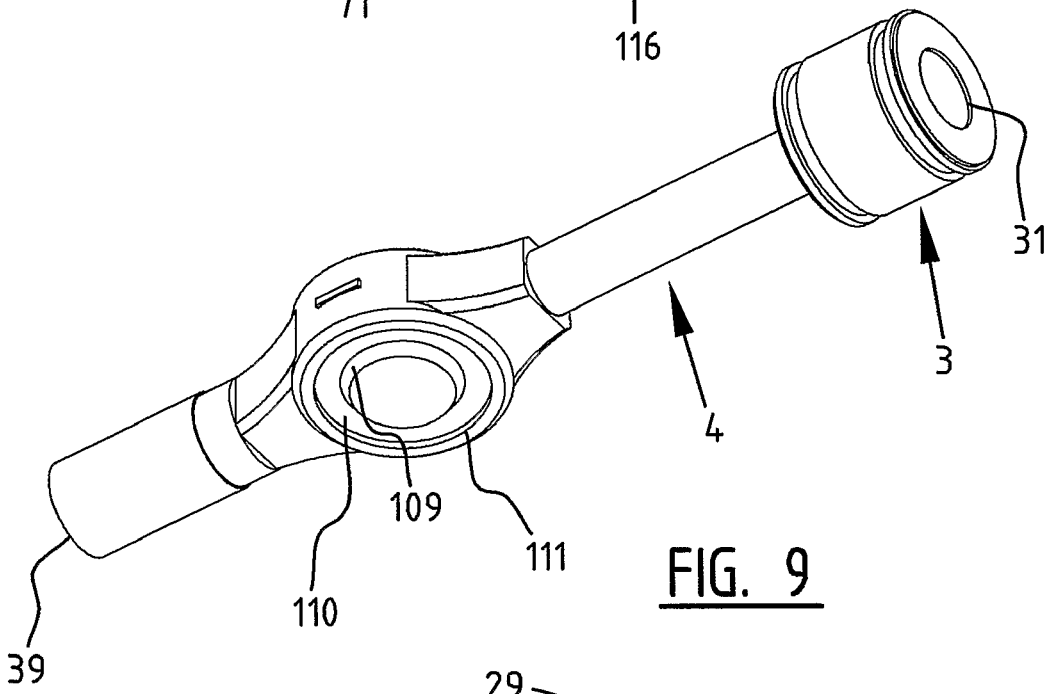
FIG. 9 is a perspective view of the piston, piston rod and the ball joint as applied in the internal combustion engine of FIG. 8.

For the connection of the piston rods 4 with the arms 5 onto the wobble disc 65, use is made, in the sample shown, of universal joints 66 (FIG. 7). Each universal joint 66 is formed by a fork 67 fastened onto the free end of the piston rod 4. This fork 67 shows two openings 68, in which two arms 69 of a cross 70 pivotably are supported in bearings. The two other arms 71 of the cross 70 are pivotably supported in bearings in a gaff 72 at the free end of the arm 5.

Because this free end of the arm 5 at the wobble movement around the rotating main shaft 8 does not move entirely rectilinearly, but describes an arc of which the middle point is at the centre line of the main shaft 8, the cross 70 can also be moved during the wobble movement to a lesser extent to and from the main shaft 8. In order to prevent that because of it the universal joint 66 and with it the piston rod 4 is loaded transversely to the direction of movement of the piston 3, the arms 69 are not only pivotable, but also slidably supported in bearings in the openings 68.

Figure 8:
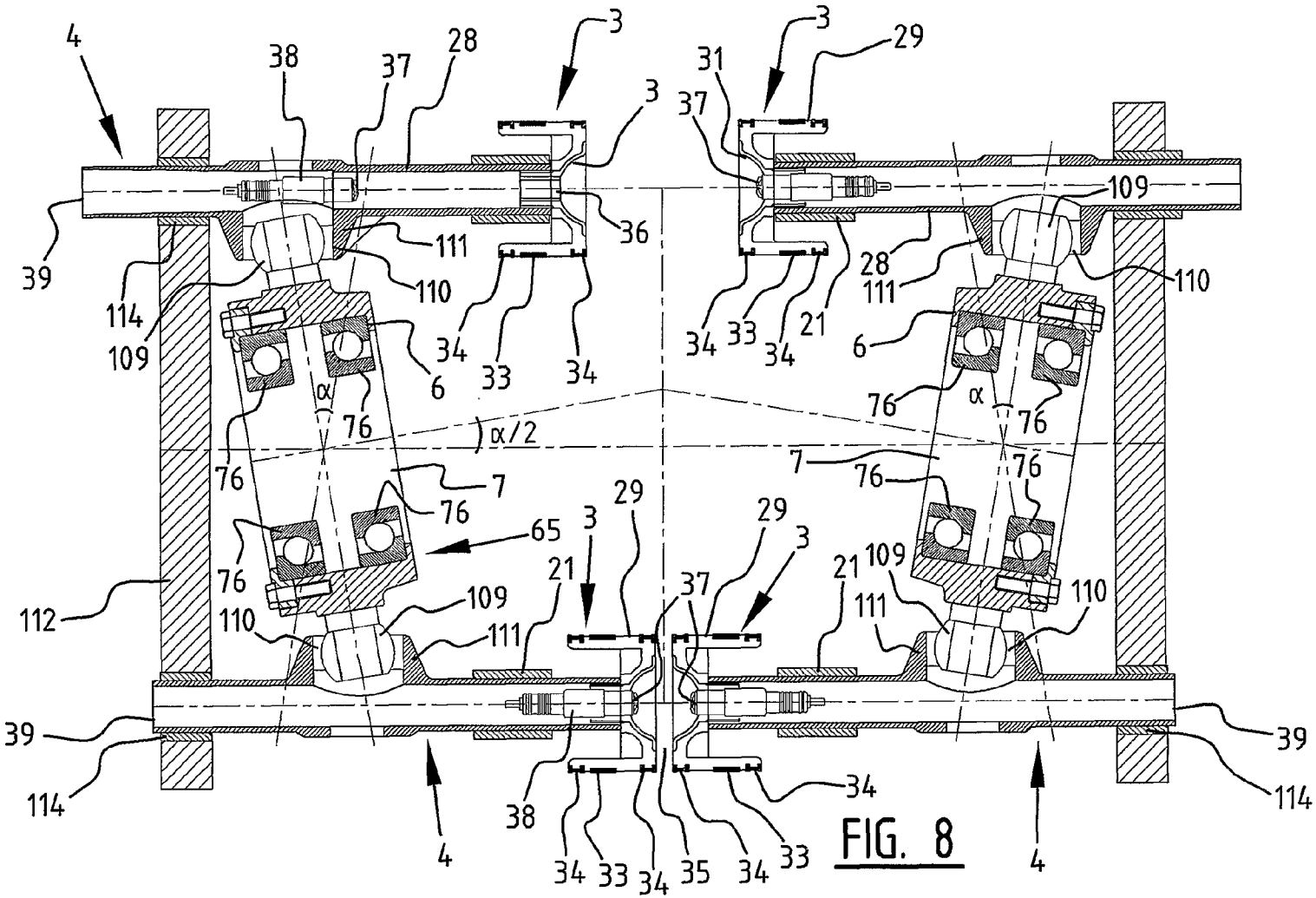
FIG. 8 shows in a longitudinal section the most important components of the transmission between the pistons and the main shaft, whereby an alternative connection between the piston rods and the wobble discs is applied.

For an alternative embodiment, instead of the universal joint 66, a ball joint 109 is applied (FIG. 8). This ball joint 109 is supported in bearings in an opening 110 in the circumferential wall 28 of the piston rod 4. In order to keep sufficient space free in the piston rod 4 to allow—hereafter to be discussed—a spark plug 38 to pass, the side-wall 28 shows at the location of the ball joint 109 a protruding part 111. In this embodiment the internal combustion engine 1 further is provided with two additional plates 112, 113, which are fitted at some distance outside the end plates 12, 13. In these plates 112, 113 sliding bearings 114 have been constructed, which form an additional bearing for the piston rods 4. Also the main shaft 8 can additionally be supported in bearings in the end plates 112, 113, although this has not been shown here.

Moreover, each piston rod 4 and corresponding piston 3 is provided with a lubrication means supply line 26, 27, because of which lubrication can be transported from a central supply point on the one hand to the outside circumference 28 of the piston rod 4, in order to lubricate the sliding movement in the guide bush 21, and on the other hand to the casing 29 of the piston 3, in order to lubricate in this way the movement of the piston 3 along the inside wall 30 of the cylinder 2. The lubrication means supply line 27 in the piston 3 runs in the neighbourhood of the piston bottom 31, which is cooled in this way to some extent.

The lubrication means supply line 27 ends in a round going groove 32 in the piston casing 29, which functions as outflow opening and in which a ring 33 of permeable material for the lubrication means is included. In this manner a very accurate metering of relatively small quantities of lubrication means along the cylinder wall 30 is guaranteed. In order to practically close in the lubrication means around the piston 3, ring-shaped piston rings 34 have been constructed on both sides of the outflow opening 32, which protrude to some extent outside the piston casing 29. These piston rings 29 are made relatively wide, and show an 1-shaped cross section, of which the use will be explained hereafter.

The bottom 31 of each piston 3 is made half ball-shaped in the example shown, so that the two pistons 3 in the cylinder 2 determine together a mainly ball-shaped combustion space 35 (FIGS. 2, 4A, 6, 8). However, a true ball shape can only be obtained at the highest compression ratio. As will be explained hereafter, the shape of the combustion space 35 deviates further and further from the ball shape at decreasing compression ratio.

In one or both pistons 3 the piston bottom 31 is provided with a central opening 36, through which the head 37 of a sparkplug 38 protrudes. In the shown example the spark plug 38 is placed at the relatively cool intake side of the engine 1, as will be discussed hereafter. The body of the spark plug 38 thereby is fastened in the piston rod 4, which is made hollow. The end 39, opposite the piston 3, of the piston rod 4 is open, so that the spark plug 38 can be reached from that end 39 of the piston rod 4, for example in order to be able to replace it.

Figure 10:
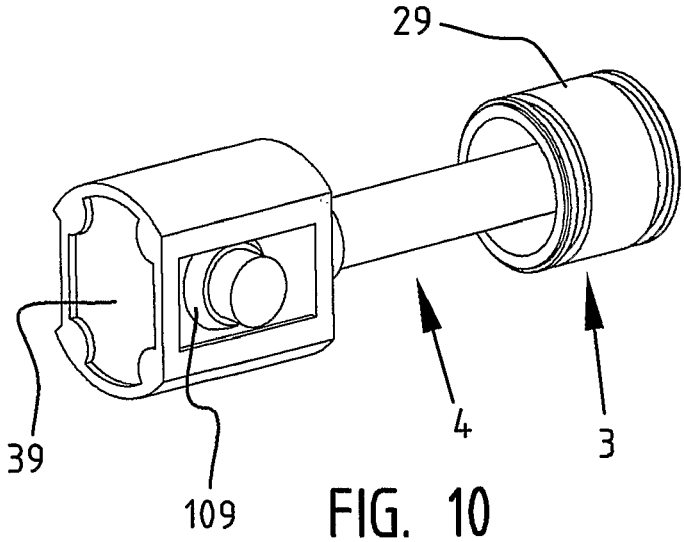
FIG. 10 is a perspective view of the piston and again another embodiment of the piston rod and the ball joint.

Also the connection between the piston rod 4 and the wobble disc 65, at the first embodiment, thus the universal joint 66, is of course constructed hollow 116. As discussed above, in the alternative embodiment of the connection as shown in FIG. 8, the ball joint 109 is supported in bearings at the outside of the hollow piston rod 4. In order to have sufficient possibilities to be able to handle the spark plug 38, the free end 39 of the piston rod 4 is made widened (FIG. 10) for yet another variant.

Apart from it, in the shown example all four pistons 3 have been provided with a central opening 36. In addition to production technical advantages—a single piston design is sufficient—this offers interesting possibilities for the use of the engine 1. Thus, spark plugs 38 can be taken up in both pistons 3 (FIG. 8). When these two sparkplugs 38 are supplied with voltage at each working stroke of the engine 1, a double ignition and a quicker and more equal combustion is achieved with it. This results into better performances, a lower usage and a reduced emission of the engine 1. On the other hand it is thinkable that the spark plugs 38 are supplied with voltage alternately. In that case their life expectancy increases considerably, so that they have to be exchanged less regularly. Finally it is of course possible that only a single spark plug 38 per cylinder 2 will do. For this purpose the not used spark plug opening 36 has to be capped with a (not shown here) plug.

Figure 4A:
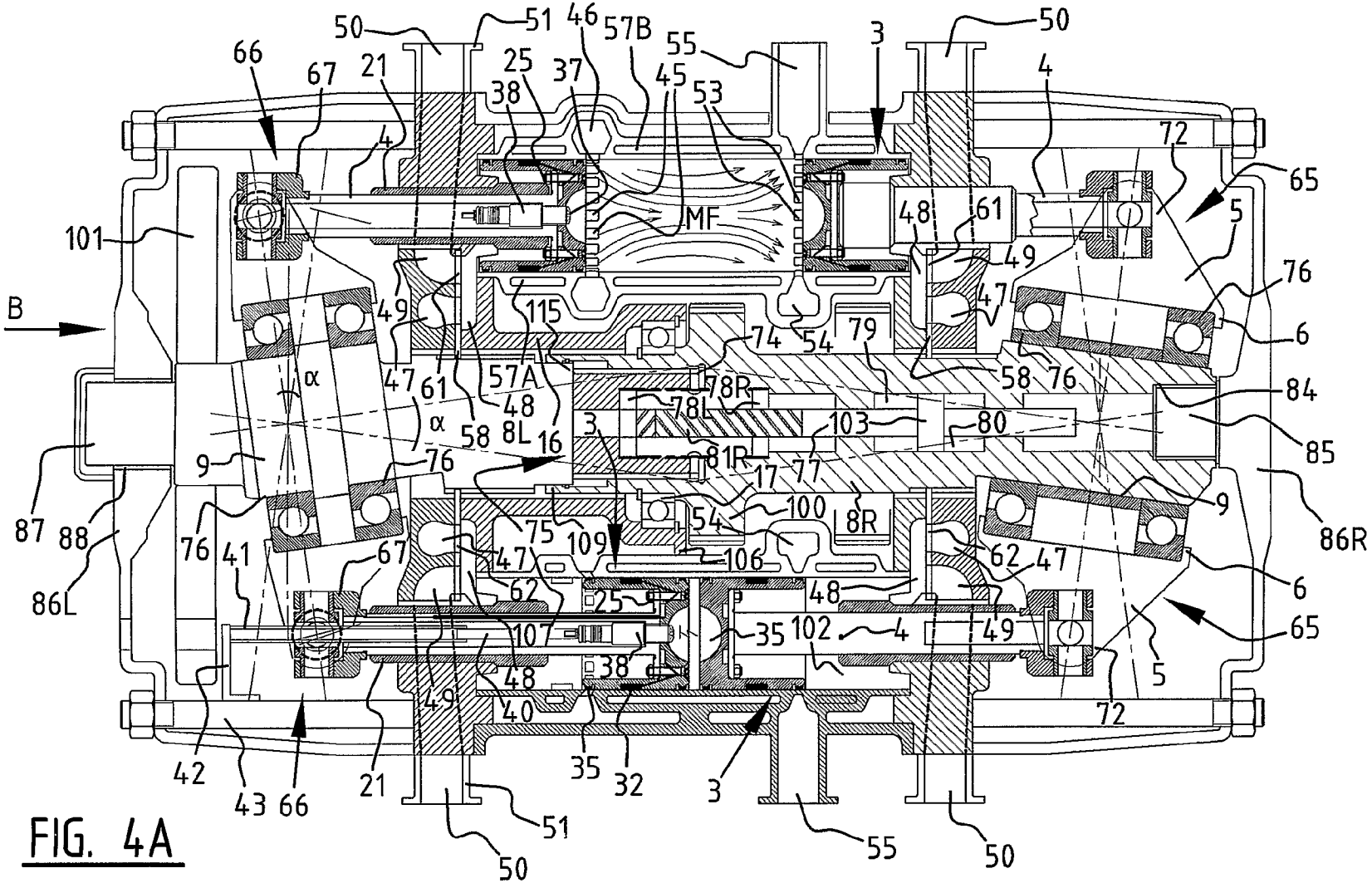
FIG. 4A shows a longitudinal section of the completely assembled internal combustion engine.

For the supply of voltage to the spark plug 38 it is connected with an electrical conductor 40, which extend into the hollow piston rod 4. This conductor 40 is movable along an elongated voltage supply element 41, because of which the voltage is transferred via flash over to the conductor 40. In the embodiment of FIG. 4A is this voltage supply element 41 is presented as a tube, which stands on a foot 42 on a part 43 of the engine frame and extends in the hollow piston rod 4 around the conductor 40. In another embodiment, as presented in FIG. 6, the conductor 40 shows a voltage supply part 44 that sits against the outside circumference 28 of the piston rod 4, and the voltage supply element 41 is included in the guide bush 21.

Figure 4B:
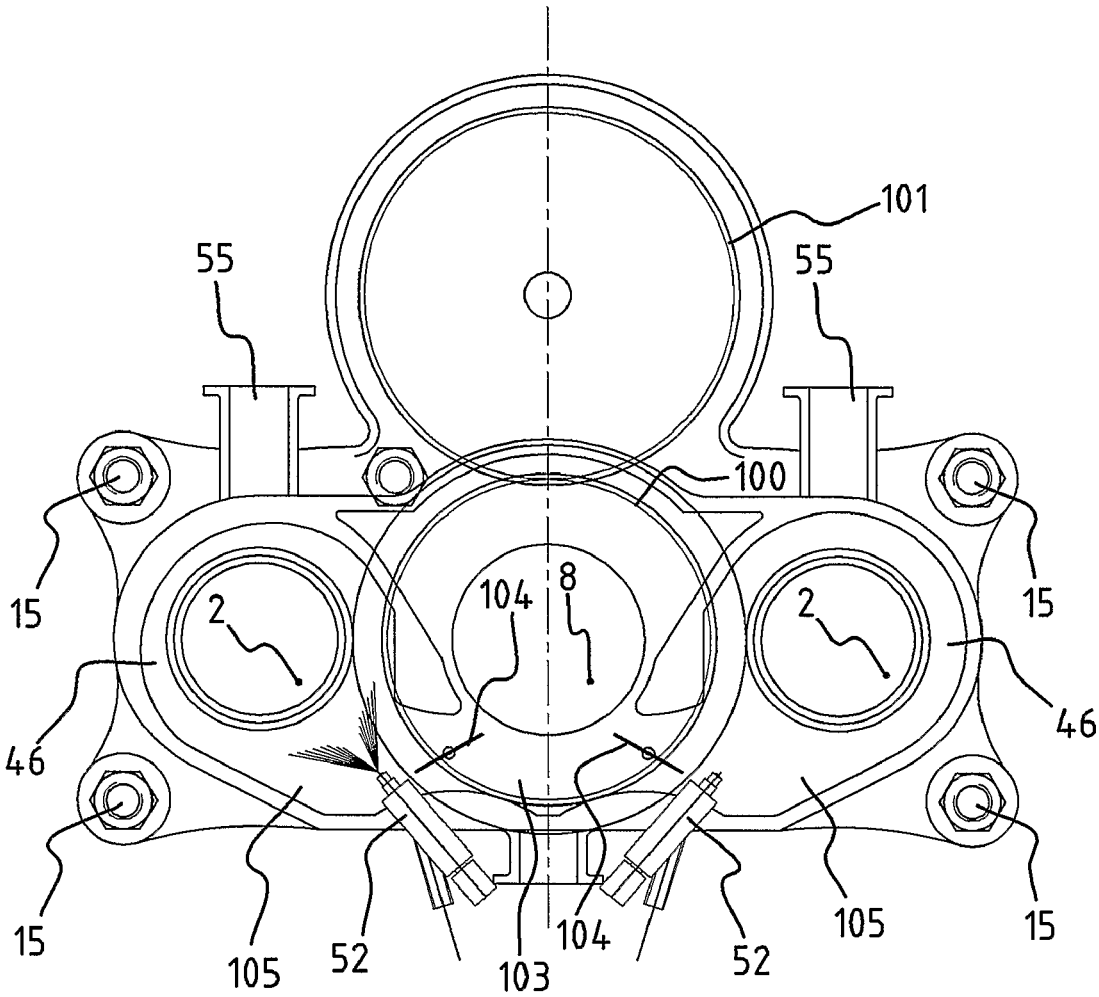
FIG. 4B shows an end view according to the arrow B in FIG. 4A, in which components present in various planes in the engine are shown schematically.
Figure 5:
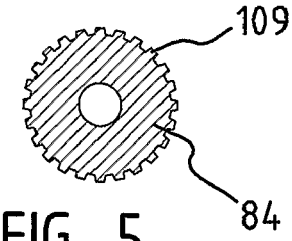
FIG. 5 shows a cross section of a half of the main shaft with on it an spline.
Figure 4C:
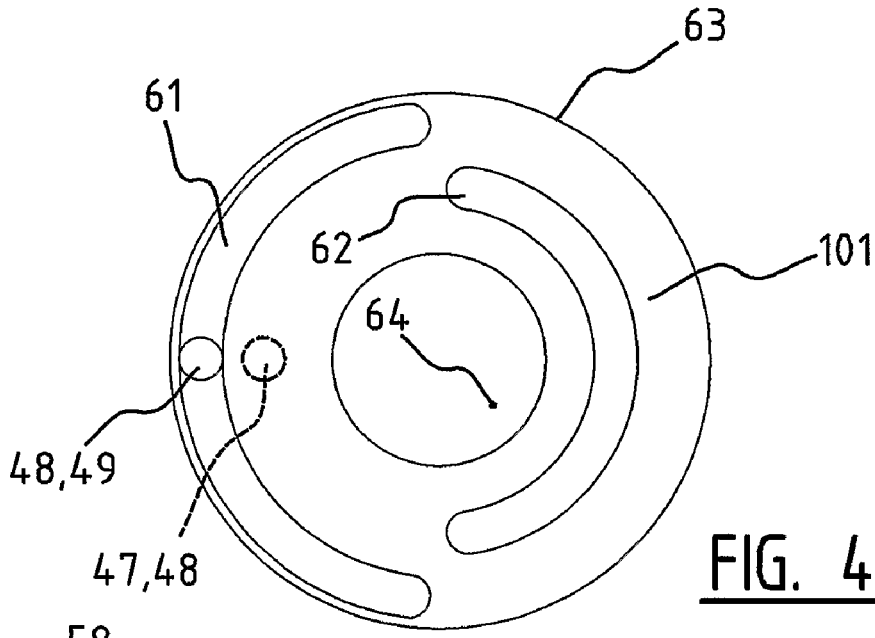
FIG. 4C shows the metering device with the circle segment-shaped openings, FIG. 4D schematically shows the position of the metering disc with regard to the other components—that are located in other planes—of the fuel/air supply system.
Figure 4D:
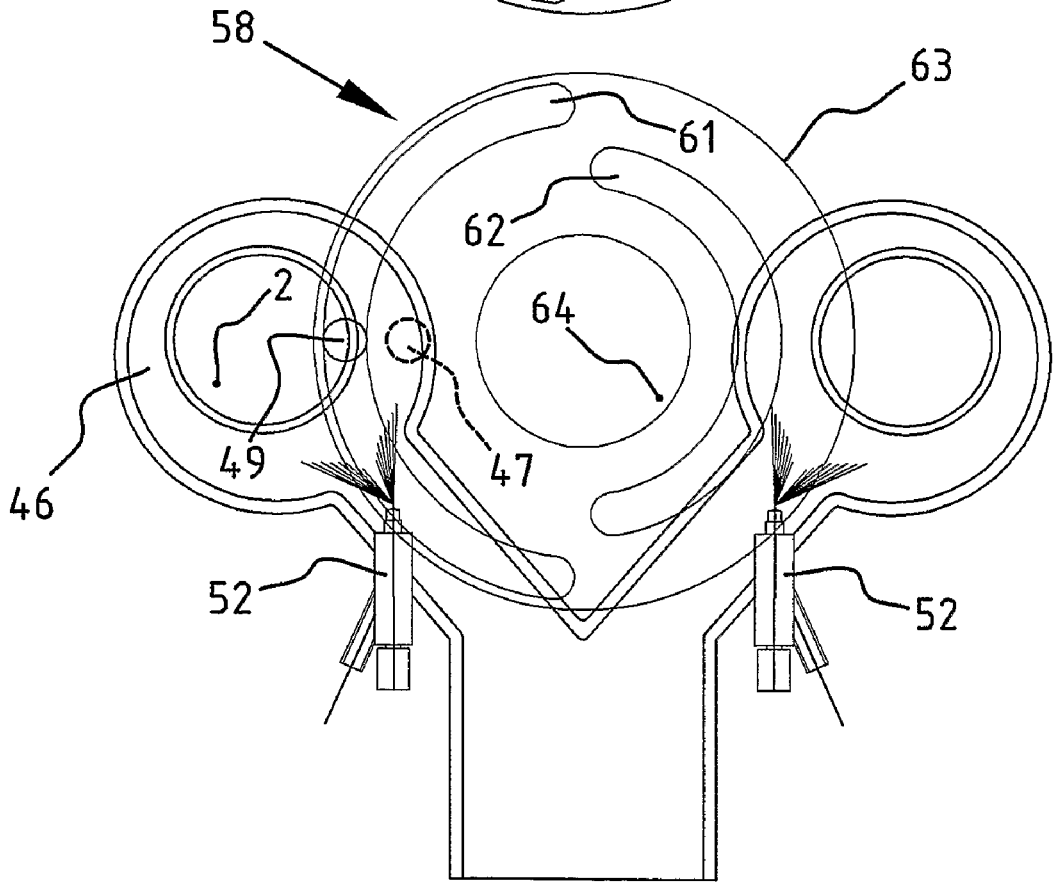
Figure 6:
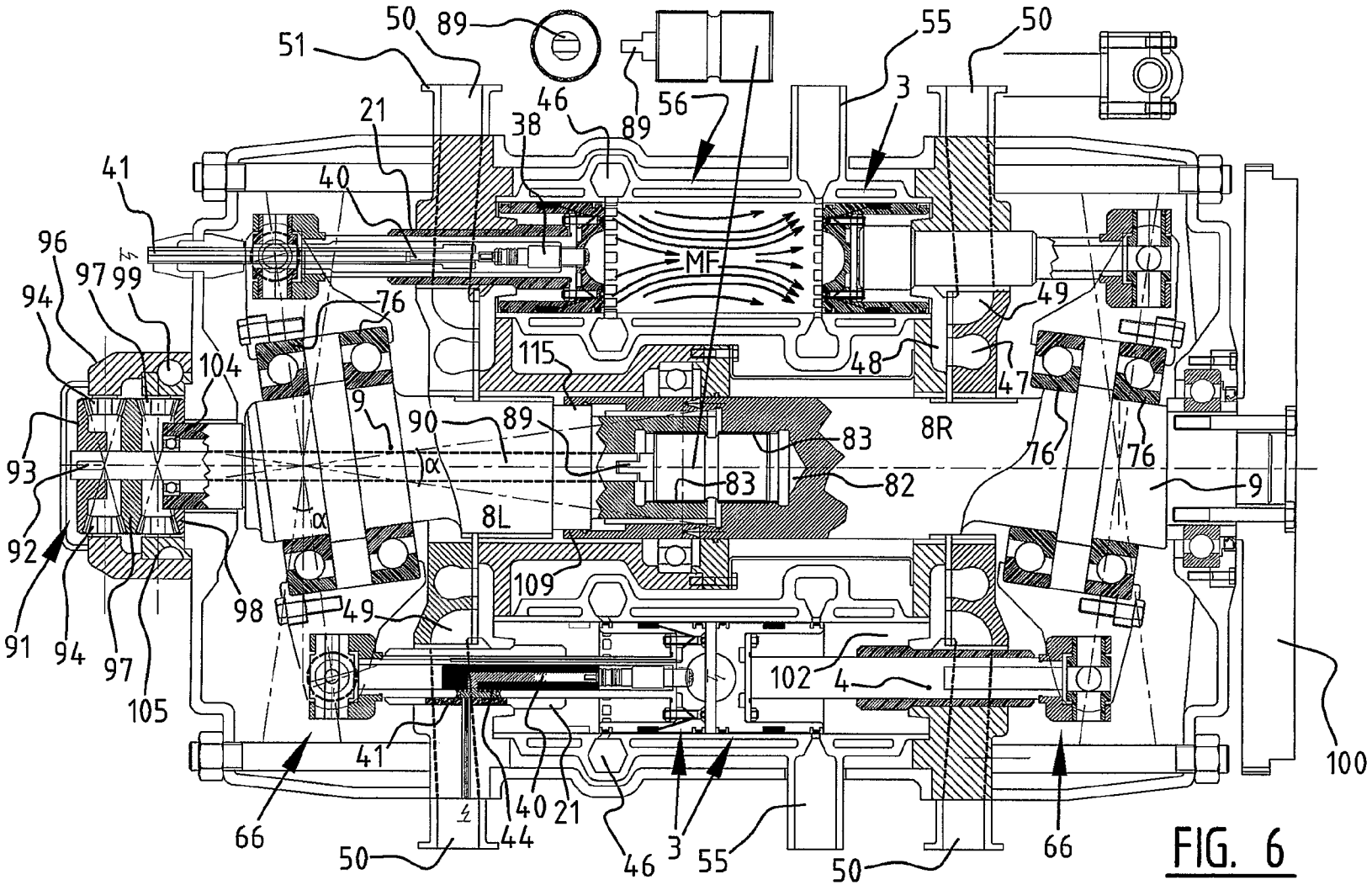
FIG. 6 shows a longitudinal section of the internal combustion engine with an alternative embodiment of the means for varying the compression ratio.

The cylinders 2 are each provided with a fuel/air mixture through intake openings 45 that are made divided in the cylinder wall 30 and are connected with a ring line 46 (FIG. 4A, 6). The ring line 46 is in its turn connected with a manifold 103 in which supplied air is collected. Between this collection manifold 103 and the ring lines 46 throttle valves 104 can be fitted (FIG. 4B), but it is also thinkable that the air supply is entirely controlled by a metering system, to be discussed hereafter, on basis of a disc-shaped metering device 58 (FIG. 4C). Moreover, the diameter of each ring line 46 can be mainly constant, as shown in the right-hand side half of FIG. 4B. However, this diameter can also—considered from the connection with the collection manifold 103—decrease in the direction of flow of the fuel/air mixture, as can be seen in the left-hand side half of FIG. 4B, if that is considered advantageously for an equal distribution of the mixture over the cylinder 2. Moreover, in the shown examples the ring line 46 is provided with a widened injection manifold 105 at the location of the connection with the collection manifold 103. In this injection manifold 105 an injection device 52 is included, with which fuel is mixed with the sucked-in air.

The collection manifold 103 is connected via a (not shown here) line with line segments 47 that are formed in the neighbourhood of the openings 18, 19 in the end plates 12, 13. Opposite these line segments 47, in each end plate 12, 13 are line parts 48 that extend radially with regard to the main shaft 8, which each are in connection with a scavenging space 102 behind the corresponding piston 3. Opposite these line parts 48, thus next to the first line segments 47, but on larger distance from the openings 18, 19, each time there is a supply opening or mouth 49 of a supply line 50, which extends radially through the end plate 12 and can be connected via a flange 51 with a (not shown here) suction tube for air.

For the metering of the fuel/air mixture or at least the sucked-in air, in the shown example as said (also) use is made of two disc-shaped metering devices 58, which each show a central opening 64 and are fastened rotation-tight onto the main shaft 8. Each disc-shaped metering device 58 extends from between the first line segment 47 and the mouth 49 of the supply line 50 on the one hand and the radial line part 48 on the other hand. In order to make this metering device 58 rotating and supported in bearings in the end plate 12, the first line segment 47 and the mouth 49 are included in a plate part 59, which is fastened in a recess 60 in the respective end plate 12, 13.

Each metering device 58 is provided with a number of metering openings 61, 62, here in the shape of circle segments, which during a part of each rotation of the main shaft 8 stands in governing with the various openings or line parts in the end plate 12, resp. 13. In the shown example the metering disc 58 shows a first metering opening 61 nearby its outside edge 63, which extends to about over half the circumference. This first metering opening 61 forms a connection between the supply opening or mouth 49 of the supply line 50 and the radial line part 48. The metering device 58 further shows a second metering opening 62, which is formed on another radius, in this case closer to the central opening 64. This metering opening 62, which covers about half the circumference of the metering disc 58, makes the connection between the radial line part 48 and the line segment 47, that finally is connected with the ring line 46. Thus, at each rotation of the main shaft 8 with on it the metering disc 58, alternately the mouth 49 is connected with the radial line part 48 and thereafter this line part 48 is connected with the line segment 47. Thereby, during a compression stroke of the pistons 3, when they move from their bottom dead point (BDP) to their top dead point (TDP), air is sucked in from the supply line 50 via the mouth 49 and the metering opening 61 into the scavenging space 102. During the following working stroke of the pistons 3 from their BDP to their BDP that air is then pressed in via the radial line part 48 and the line segment 47 into a (not shown here) connection line, which leads to the collection manifold 103. From it the air will then flow to the ring line 46, where fuel will be injected, after which the fuel/air mixture formed in this way flows via the intake openings 35 into the cylinder 2.

It is remarked that in the bottom half of FIG. 4A an alternative for the ring line 46 is shown. There, use is made of an end wall 106, which protrudes from the bearing bush 16 and connects, while sealing, with the cylinder wall 30. This end wall 106 determines with the cylinder wall 30, the bearing bush 16 and the end plate 12, a supply manifold 107, from which the fuel/air mixture flows into the intake openings 35.

After combustion, the exhaust gasses from each cylinder 2 are discharged via a number of exhaust openings 53 formed in the cylinder wall 30, which are also connected with a ring line 54. The direction of flow of the gasses in the cylinder 2 is thus as indicated by the arrows MF from left to right in the drawing. The ring line 54 at the exhaust side ends into a discharge line 55, which in its turn is connected with an (not shown here) exhaust system.

As indicated above, the piston rings 34 are made relatively wide. In any case they should show such a width that they can pass the intake openings 45 and the exhaust openings 53 without any problems. The width of the piston rings 34 is for this purpose at least equal to the dimensions of the intake and exhaust openings 45, 53 in the direction of movement of the pistons 3.

In the shown example, the ring lines 46, 54 for supplying the fuel/air mixture, respectively the discharge of the exhaust gasses are formed as one part with the cylinder 2. This also applies for a cooling casing 56, which determines a number of mutually connected channels 57A, 57B, 57C for a cooling liquid around the cylinder wall 30. Moreover, the cylinder wall 30 is also formed as one part between the end plates 12, 13. Thus, a division in the symmetry plane of the engine is not the case, as is the case with the known wobble disc engine.

Although the cylinder 2 in the shown examples between the end plates 12, 13 is fixed, it is also thinkable that it is slidably supported in bearings. When moving the cylinder 2, the amount of overlap between the pistons 3 and the intake and exhaust openings 45, 53 varies, as well as the moment that these openings 45, 53 are released by the pistons 3. In this way the capacity provided by the engine 1 can be controlled. Such a control would make the throttle valves 104 superfluous, in addition to the capacity also the usage and the emission can of course be controlled in this manner.

As said an internal combustion engine of the type described so far, a so-called wobble disc engine, is excellently suitable for varying in a simple manner the compression ratio, thus the ratio between the total stroke volume of the cylinder 2, when the two pistons 3 are in their bottom dead point (BDP), and the capacity of the combustion space 35 is determined by the pistons 3 in their top dead point (TDP). According to the present invention the wobble disc-engine 1 provides means 73 for varying the compression ratio formed by the combination of a division 74 in the main shaft 8 and drive means 75 for the moving apart of the shaft parts 8L, 8R formed in this way with respect to each other.

In the examples shown the drive means 75 comprise each time a screw spindle 77, which is supported in bearings in one of the shaft halves 8L, 8R and cooperates in any case with a nut 78 taken up in the other half of the shaft. This nut 78 shows two oppositely directed screw thread segments 78L, 78R, which each cooperate with one of the shaft parts 8L, 8R (FIG. 4A, 6). For turning the screw spindle 77, use can be made of an electro motor or a hydromotor.

In the embodiment according to FIG. 4A the screw spindle 77 is moved by means of pressing a hydraulic liquid into one of the manifolds 79, 80 at both sides of a piston connected with the screw spindle 77. The screw spindle 77 is provided here with a screw thread segment 81 R with large pitch, which cooperates with an internal screw thread segment 81 L in the nut 78. Thus, when moving the spindle 77 the nut 78 will be rotated, whereby the oppositely directed segments 78L, 78R in their turn cooperate with internal screw thread 82 in hollows 83 in the shaft parts 8L, 8R, which because of it move apart from each other or into each other. Thus the distance between the bearing segments 9 and with it thus the distance between the wobble discs 65 and between the pistons 3 in both their BDP as well as their TDP is changed. This change leads to a change of the compression ratio of the wobble disc engine 1.

Because one of the shaft parts, here the right-hand side shaft part 8R, in the longitudinal direction is immovably supported in bearings, the other shaft part 8L thus will move reciprocatingly. For the bearing of the shaft half 8R this is provided with a recess 84 that grips around a shaft stub 85, which is fastened onto a closing part 86R of the engine frame. Contrary to it, the other shaft half 8L itself shows a shaft stub 87 that is slidably supported in bearings in an opening 88 in an oppositely closed part 86R of the engine frame. The bearing segment 9 on the half 8R with fixed bearings of the main shaft is not loaded in the longitudinal direction of the shaft 8, and therefore can be formed simply. Contrary to it, the bearing segment 9 on the slidable shaft half 8L has been profiled in order to be able to pass on the loads to the wobble disc 65.

Apart from that the two shaft halves 8L, 8R also show a so-called AsplineΘT 108, resp. 115, with which they are mutually connected in a rotation-free manner. These Asplinesø 108, 115 are, with respect to each other, slidable in axial direction, with teeth gripping into each other on the outside circumference of the shaft half 8L, resp. the inside circumference of the shaft half 8R (FIG. 4A, 6), which pass on the torque exerted on these two shaft halves 8L, 8R.

In an alternative embodiment of the compression ratio variation means 73 the drive of the screw spindle 77 is not made in the main shaft 8, but outside it. (FIG. 6). Thereby the screw spindle 77 with opposite screw thread segments 81 L, 81 R directly connects with the internal screw thread 82 in hollows 83 in the shaft parts 8L, 8R. The relatively thick screw spindle is connected via a claw torque 89 connected with a connecting rod 90, which extends trough the main shaft 8 to outside the engine frame. This rod 90 is supported by means of a roller bearing 91 nearby the end of the main shaft 8, and extends from it through a differential 91.

With the aid of a key 92 the end of the rod 90 is connected fixedly against rotation with a tooth disc 93 of the differential 91, which in its turn is connected via cone-shaped toothed wheels 94 with a toothed intermediate disc 95. The cone-shaped toothed wheels 94 are supported in bearings in a rotatable ring 96. The intermediate disc 95 is connected via a second set of cone-shaped toothed wheels 97 with fixed teething 98 on the engine frame. The cone wheels 97 are supported in bearings in a fixed ring 98, which is connected with the rotatable ring 96 via a worm 99. When turning this worm 99, the rotatable ring 96 is turned around the fixed ring 98, because of which the rod 90 is rotated, and with it the screw spindle 77. By putting the differential 91 in-between, the screw spindle 77 in this embodiment can be turned both with a running engine as well as when the engine is not running.

For the transfer of the turning moment of the main shaft 8 as a consequence of the continuous wobble movements of the wobble discs 65 onto one or more users, the main shaft 8 is provided with a toothed ring 100. This can be in mesh with one or more toothed wheels 101 (FIG. 4B), which convey the turning moment to outside the engine. Thereby these toothed wheels 101 can be executed as fly-wheel. The position of the toothed ring 100 on the main shaft 8 can in principle be chosen freely. Therefore it is placed in the embodiment of the engine according to FIGS. 1 and 2 nearby the end plate 13, while in the embodiment of FIG. 4A a central place is chosen. Finally in the embodiment of FIG. 6, the toothed ring 100 is executed itself as fly-wheel and mounted onto the free end of the main shaft 8.

Thus the above-described so-called wobble disc-engine according to the present invention offers a large number of advantages compared to the older engine design. Although the invention above is elucidated on basis of a number of examples, it will be clear that it is not limited thereto, but can be varied in many different ways. In particular all new aspects of the invention can be applied in various combinations while retaining the advantages connected with it. Therefore the scope of the invention is thus also exclusively specified by the following claims.

The invention claimed is:

1. Internal combustion engine, comprising:

at least one cylinder with two oppositely directed reciprocatingly movable pistons in it, which are each connected via a piston rod with a corresponding arm, whereby each arm shows an opening in which a main shaft that connects the two arms is rotatably supported in bearings, which main shaft includes an angle with a centre line of each opening, and means for varying the compression ratio in the cylinder, characterised that the compression ratio variation means comprise a division in the main shaft, as well as drive means in order to move the parts formed by it of the main shaft apart from each other.

2. Internal combustion engine according to claim 1, characterised that the drive means comprise a screw spindle included at the division in the main shaft, which is supported in bearings in one of the shaft parts and cooperates with a nut taken up in the other shaft part.

3. Internal combustion engine according to claim 2, characterised that the drive means comprise an electro or hydromotor, taken up in the main shaft, which drives the screw spindle.

4. Internal combustion engine according to claim 2, characterised that the drive means comprise an adjustment devise, placed outside the main shaft, and connected via a differential with the screw spindle.

5. Internal combustion engine according to one of the preceding claims or according to the beginning of claim 1, characterised by at least one spark plug, which protrudes through the bottom of one of the pistons.

6. Internal combustion engine according to claim 5, characterised that the piston rod is hollow, and the spark plug is fastened in the piston rod.

7. Internal combustion engine according to claim 6, characterised that the end showing away from the piston rod is open.

8. Internal combustion engine according to claim 5, characterised by an electrical conductor connected with the spark plug, which extends into the piston rod, of which a voltage supply part is movable along an elongated voltage supply device.

9. Internal combustion engine according to claim 1, characterised by means for the metering to the cylinder of a supply of air or a fuel/air mixture, which supply means comprise a rotatable metering device along at least one supply opening, connected with the main shaft, which shows at least one metering opening, which can be brought into governing with the supply opening via rotation of the metering device.

10. Internal combustion engine according to claim 9, characterised that the metering opening has the shape of a circle segment.

11. Internal combustion engine according to claim 10, characterised that the metering device shows multiple circle segment shaped metering openings on various radii and/or various lengths.

12. Internal combustion engine according to claim 1, characterised that each piston rod is slidably included in a guide bush, and connected with the corresponding arm by means of a movable universal joint transversely to the direction of movement of the piston.

13. Internal combustion engine according to claim 1, characterised by a system for the lubrication of the pistons, comprising at least one lubrication means supply line included in the piston rod of the piston to be lubricated and at least one outflow opening connected with the supply line in the casing of the piston.

14. Internal combustion engine according to claim 13, characterised that the lubrication means supply line runs in the neighbourhood of the piston bottom.

15. Internal combustion engine according to claim 13, characterised that lubrication permeable material is included in the outflow opening.

16. Internal combustion engine according to one of the claim 13, characterised that the piston on both sides of the outflow opening shows ring shaped piston rings around the piston casing.

17. Internal combustion engine according to claim 16, characterised that in the wall of the cylinder, intake and exhaust openings are formed, and the width of the piston rings is at least equal to the diameter of those openings.

18. Internal combustion engine according to claim 1, characterised that the cylinder wall is formed as one part.

19. Internal combustion engine according to claim 1, characterised by a cooling casing enclosing the cylinder.

20. Internal combustion engine according to claim 1, characterised that the cylinder is slidable into the direction of movement of the pistons.

21. Internal combustion engine according to claim 1, characterised by a number of cylinders equally divided around the main shaft, whereby the arms of the various pistons are fastened to a common bearing ring that determines the opening of each arm.

22. An internal combustion engine, comprising:

at least one cylinder with two oppositely directed reciprocatingly movable pistons in it, which are each connected via a piston rod with a corresponding arm, whereby each arm shows an opening in which a main shaft that connects the two arms is rotatably supported in bearings, which main shaft includes an angle with a centre line of each opening, a division in the main shaft which forms shaft parts; and a drive to move the shaft parts apart from each other.

* * * * *